United States Patent [19]

Coleman-Kammula et al.

[11] Patent Number: 4,851,010

[45] Date of Patent: Jul. 25, 1989

[54] PROCESS FOR THE PREPARATION OF POLYMER-GRAFTED CELLULOSE FIBERS BY REACTING CARBOXYMETHYL CELLULOSE PEROXIDE WITH VINYL MONOMER

[75] Inventors: Seetha Coleman-Kammula; Harold Hulskers, both of Amsterdam, Netherlands

[73] Assignee: Shell Oil Company, Houston, Tex.

[21] Appl. No.: 141,855

[22] Filed: Jan. 11, 1988

[30] Foreign Application Priority Data

Apr. 14, 1987 [GB] United Kingdom ..... 8708960

[51] Int. Cl.[4] ..... C08F 251/02; D06M 14/04

[52] U.S. Cl. ..... 8/115.62; 8/115.67; 8/116.1; 8/120; 8/129; 8/193; 8/194

[58] Field of Search ..... 8/129, 115.62

[56] References Cited

U.S. PATENT DOCUMENTS

| | | | |
|---|---|---|---|
| 3,492,082 | 1/1970 | Lee | 8/120 |
| 4,689,045 | 8/1987 | Armagnacq | 8/120 |
| 4,748,076 | 5/1988 | Saotome | 8/115.62 |

*Primary Examiner*—A. Lionel Clingman

*Attorney, Agent, or Firm*—Wendy K. B. Buskop

[57] ABSTRACT

A process for graft-polymerizing vinyl monomers onto cellulose fiber materials, by reacting by a fibrous carboxymethyl cellulose peroxide having a degree of substitution for the peroxide groups from 0.02 to 0.11, with a vinyl monomer in an aqueous medium in the presence of a ferrous iron compound at a temperature from 20° to 95° C.

10 Claims, No Drawings

PROCESS FOR THE PREPARATION OF POLYMER-GRAFTED CELLULOSE FIBERS BY REACTING CARBOXYMETHYL CELLULOSE PEROXIDE WITH VINYL MONOMER

BACKGROUND OF THE INVENTION

The invention relates to a process for graft-polymerizing vinyl monomers onto cellulose fiber materials and to polymer-grafted cellulose fiber materials prepared according to said process.

Judging from the large number of articles which have been published in recent years it can be observed that polymer-grafted cellulose fiber materials are receiving an increasing amount of attention. Depending on their composition these polymer-grafted cellulose fiber materials may be used for a variety of applications such as in paper making and as a reinforcing component in polymer composites.

Many of the methods which have been proposed for the preparation of these polymer-modified cellulose materials, have in common that a vinyl monomer is graft-polymerized onto a cellulose fiber material in the presence of an initiator system. In some of these methods an external initiator was employed, i.e. a system wherein the initiating compound was not chemically bonded to the cellulose material. Generally such a method resulted in a mixture of polymer-grafted cellulose fiber material and a considerable amount of the corresponding homopolymer, which is of course economically not very attractive when the prime interest lies in the production of the polymer-grafted cellulose fiber material. Other methods, wherein an internal initiator was employed, generally provided a higher yield of the polymer-modified cellulose material vis-a-vis that of the homopolymer. Such internal initiators may be obtained by chemically modifying the cellulose material to contain one or more peroxide groups. However, with some of the methods used for introducing the peroxide groups in the cellulose material, a cocurrent cleavage of the cellulose macromolecules is known to occur.

A method for the preparation of cellulose fiber materials containing internal initiator groups and which does not suffer from the macromolecule cleavage phenomenon as described hereinbefore, is known from the Journal of Applied Polymer Science, Vol. 23, 241–247 (1979). According to this method, a cellulose material is reacted with monochloroacetic acid and the carboxyl groups are subsequently converted to peracid groups via a reaction with sulfuric acid and hydrogen peroxide. The resulting carboxymethyl cellulose (CMC) peroxide was employed to study the preparation of polymer-grafted cellulose materials via a thermal- or photo-initiated graft-polymerization in combination with a number of vinyl monomers. The photoinitiated graft-polymerization was found to be superior to that of the thermal-initiated method, resulting in higher grafting percentages and graft efficiency, wherein grafting percentage and graft efficiency are defined as follows:

$$\text{grafting percentage (\%)} = \frac{\text{weight of grafts}}{\text{weight of } CMC \text{ peroxide}} \times 100$$

$$\text{graft efficiency (\%)} = \frac{\text{weight of grafts}}{\text{weight of homopolymer and grafts}} \times 100$$

However with the exception of acrylamide the monomer conversion was rather low. Also, the grafting percentage left room for improvement, with the exception of acrylamide. Another disadvantage related to the photo-initiated graft-polymerization is that it required special equipment which was restricted to small scale use.

The present invention provides a method for the preparation of polymer-grafted cellulose fiber materials which does not suffer from one or more of the disadvantages described hereinbefore.

Surprisingly it has now been found that when the preparation of polymer-grafted cellulose materials is conducted via a method which employs a CMC-peroxide, as described hereinbefore, in combination with a ferrous salt, very high grafting percentages in combination with a high graft efficiency and monomer conversion, requiring special equipment which would restrict larger scale application of the method.

SUMMARY OF THE INVENTION

The invention provides a process for graft-polymerizing vinyl monomers onto a cellulose fiber material which comprises the reaction of a fibrous carboxymethyl cellulose peroxide having a degree of substitution (DS) for the peroxide groups in the range of from 0.02 to 0.11, with a vinyl monomer in an aqueous medium in the presence of a ferrous iron compound at a temperature in the range of from 20° to 95° C.

DETAILED DESCRIPTION OF THE INVENTION

The term degree of substitution (DS) is defined as the average number hydroxyl groups per anhydro-glycose unit of the cellulose material which have been reacted or converted.

The CMC-peroxide used in the process of the present invention is preferably derived from a carboxymethyl cellulose, having a DS for the carboxymethyl groups in the range of from 0.1 to 0.7. Preferably, the CMC-peroxide has a DS in the range of from 0.08 to 0.11.

The cellulose fiber material which may be employed in the preparation of the CMC may originate from widely different sources and can include cellulose fiber material from hard wood, soft wood, cotton linters, flax and the like.

Vinyl monomers which may be employed in the process of the present invention include vinylaromatic compounds such as styrene and α-methylstyrene, vinyl group substituted heterocyclic compounds such as the vinyl-pyridines and monomers such as vinyl acetate and acrylonitrile. Preferred vinyl monomers are those bearing a vinylcarbonyloxy group such as an acryloyl- or a methacryloyl group and include acrylic acid, methyl acrylate, ethyl acrylate, propyl acrylate, butyl acrylate, methacrylic acid, methyl methacrylate, butyl methacrylate, 2-hydroxyethyl methacrylate, 2-hydroxypropyl methacrylate and acrylamide.

The ferrous iron compound which is employed in the process of the present invention is generally employed in an equivalent ratio of $Fe^{2+}$ to per acid in the range of from 0.01:1 to 5:1 and more preferably in the range of from 0.15:1 to 0.5:1. Ferrous ammonium sulfate ($Fe(NH_4)_2(SO_4)_2.6H_2O$) is a preferred ferrous iron compound usable herein.

The graft-polymerization may be effected by dispersing the CMC-peroxide in water and subsequently adding the required amounts of monomer and ferrous iron compound. The reaction is generally conducted at a temperature in the range of from 20° to 95° C. and preferably at a temperature in the range of from 50° to 85° C. When required the process may be carried out in the presence of an appropriate amount of one or more surfactants.

By varying one or more process parameters such as the reaction time and temperature, the DS of the CMC-peroxide, the weight ratio of cellulose material and monomer and the equivalent ratio of peroxide groups and $Fe^{2+}$, it is possible to vary within limits, the grafting percentage of the polymer-grafted cellulose material, as well as the graft efficiency, the molecular weight of the polymer graft and monomer conversion.

After completion of the graft-polymerization, the reaction product, which is generally a mixture of polymer-grafted cellulose fiber material and the corresponding homopolymer, may be isolated e.g. by filtration. In view of the high graft efficiency which may be obtained with the process of the present invention, it will generally not be necessary to separate the two components of the reaction product, and the latter may be used as such in e.g. paper making or as reinforcing component in polymer composites. Should however the homopolymer be present in a concentration too great for a specific application, then this can be remedied by e.g. extracting the homopolymer with a suitable solvent.

The invention will be further illustrated by the following Examples for which the following information is provided.

Preparation of partially carboxymethylated cellulose from Whatman CF 11 cellulose powder A g cellulose powder was dispersed in B ml toluene and C ml ethanol (92.5% w). After the addition of D g of a 50% w aqueous NaOH solution, the mixture was stirred for 30 minutes. Subsequently E g monochloroacetic acid was added and under continuous stirring the mixture was heated to F °C. and maintained at said temperature for G minutes. Next the mixture was cooled down to 20° C. and acidified with a sufficient volume of a 50% w aqueous HCl solution to obtain a mixture having a pH in the range 1 to 2. After stirring for 90 minutes the solids were filtered off and washed with a 65% w aqueous methanol solution until neutral, which washing procedure was followed by washing 3 times with a 92.5% w aqueous methanol solution. After a final wash with 100% methanol the solids were dried at 20° C. under subatmospheric pressure.

An accurately weighted amount of approximately 1 g of the p-CMC thus prepared was taken up in 10 ml of a 70% w aqueous methanol solution where upon 25.0 ml 0.5N NaOH was added and the volume made up to 200 ml by the addition of demineralized water. The mixture was shaken until everything had dissolved and subsequently the excess NaOH was backtitrated with 0.1N HCl. The degree of substitution (DS) of the p-CMC can be calculated from the NaOH consumption according to the formula $$DS = \frac{0.162 \times Z}{1 - 0.058 \times Z}$$

wherein Z is the number of meq NaOH consumed per g CMC. The values which correspond to the underlined capital letters as used hereinbefore are given in Table 1, which Table also gives the product data of each of the corresponding experiments.

TABLE 1

| Exp. No. | A Whatman Cellulose g | B Toluene ml | C Ethanol (92.5%) ml | D NaOH (50% w) g | E Monochloro-acetic acid g | F Temp. °C. | G Time min | DS |
|---|---|---|---|---|---|---|---|---|
| 1 | 20 | 100 | 100 | 25.9 | 11.3 | 65 | 70 | 0.43 |
| 2 | 20 | 250 | 250 | 25.9 | 2.4 | 65 | 70 | 0.10 |

Preparation of partially carboxymethylated cellulose from Holden Vale ES 200 cotton linters A g sheeted cellulose was disintegrated in B ml of a 92.6% w aqueous 2-propanol solution which was followed by the addition of C g of a 50% w NaOH solution. Subsequently, the slurry was stirred, for 30 minutes, whereupon D g monochloroacetic acid was added. From here onwards the procedure was similar to that of the preparation of p-CMC wherein Whatman powder was employed.

The values which correspond to the underlined capital letters as used hereinbefore are given in Table 2, which Table also gives the product data of each of the corresponding experiments.

TABLE 2

| Exp. No. | A Cotton Linters g | B 2-propanol (92.6% w) ml | C NaOH 50% w g | D Mono-chloro-acetic acid g | F Temp. °C. | G Time min | DS |
|---|---|---|---|---|---|---|---|
| 1 | 20 | 900 | 33 | 8.7 | 60 | 360 | 0.57 |
| 2 | 60 | 1850 | 100 | 52 | 80 | 90 | 0.32 |

EXAMPLES I–X

Preparation of polymer-grafted cellulose fiber materials.

A g p-CMC was taken up in B ml 30% w $H_2O_2$ and cooled down to 0° C., whereupon C ml concentrated $H_2SO_4$ was added and the mixture was stirred at 20° C. for 180 minutes. Subsequently the solids, being the p-CMC peroxide, were isolated via filtration under subatmospheric pressure and washed with iced water until neutral.

In view of the problems which would arise when selecting a representative sample for analyzing the p-CMC peroxide, a duplicate run was carried out to determine the DS of the p-CMC peroxide, which determination can be conducted according to the following procedure.

The wet p-CMC peroxide of the duplicate run was taken up in approximately 30 ml 2-propanol, and after the addition of approximately 3 g KI the mixture is stirred for 15 minutes at 80° C. and subsequently cooled down to 20° C.

The amount of $I_2$ formed in the mixture is a measure for the number of peroxide groups present in the p-CMC peroxide, and can be determined via titration with a 0.1M thiosulphate solution.

The DS of the p-CMC peroxide can be calculated according to the following formula:

$$DS_{per\ acid} = \frac{I}{6.17}$$

where I represents the number of mmol iodine produced per gram sample.

The wet p-CMC peroxide of the original run was taken up in D g of deaerated demineralized water which was followed by the addition of E g monomer and F mmol $Fe(NH_4)_2(SO_4)_2.6H_2O$ (as a $21\times10^{-3}$ M solution in water). The mixture thus obtained was cooled down to 0° C. and was evacuated with $N_2$. Subsequently the mixture was stirred for G minutes and at a temperature of H °C. under a nitrogen blanket. After cooling to 20° C. the solids were isolated by filtration over a glass filter and washed with demineralized water. The solid material was transferred to a soxhlet thimble and extracted with acetone for 20 h. The residue of the acetone extraction which was dried under subatmospheric pressure at 50° C. and weighed was the polymer-grafted cellulose fiber material, while the homopolymer formed was obtained by evaporating the acetone from the acetone extract followed by drying under subatmospheric pressure.

The values which correspond with the underlined capital letters as used hereinbefore are given in Table 3 together with the product data of each of the Examples, which product data also includes weight average molecular weight of the grafted polymer.

The grafted polymer was isolated by stirring polymer-grafted cellulose with a 50-fold excess of 72% w $H_2SO_4$ during 3 h at 20° C. in which period the polymer-grafted cellulose material had dissolved. Subsequently, water was added while cooling, whereupon the polymer was precipitated. The polymer was isolated by filtration over a glass filter, washed with water until neutral and dried.

The molecular weight of the polymer species was determined according to the method as described in Journal of Applied Polymer Science Vol. 27 (1982) 1119.

TABLE 3

| Example No. | A p-CMC from Table/exp. | g | B $H_2O_2$ (30% w) ml | C $H_2SO_4$ conc. ml | DS p-CMC peroxide | D $H_2O$ g | E monomer type/g | | F $Fe(NH_4)_2(SO_4)_2$ mmol | G Time min | H Temp. °C. | Grafting % | Graft efficiency % | monomer conv. % | molecular weight $\times 10^{-5}$ |
|---|---|---|---|---|---|---|---|---|---|---|---|---|---|---|---|
| I | 1/1 | 1 | 10.5 | 2 | 0.09 | 10 | MMA[a] | 4 | 0.21 | 90 | 60 | 225 | 79 | 71 | 4 |
| II | 1/1 | 1 | 21 | 4 | 0.09 | 10 | MMA[a] | 4 | 0.21 | 120 | 60 | 305 | 79 | 96 | 5.5 |
| III | 1/1 | 1 | 21 | 4 | 0.09 | 10 | MMA[a] | 4 | 0.21 | 45 | 60 | 195 | 66 | 75 | 2 |
| IV | 1/1 | 1 | 21 | 4 | 0.09 | 10 | MMA[a] | 4 | 0.21 | 90 | 40 | 103 | 63 | 40 | 2.3 |
| V | 1/1 | 1 | 21 | 4 | 0.09 | 10 | MMA[a] | 4 | 5.25 | 90 | 60 | 80 | 80 | 40 | 0.8 |
| VI | 1/1 | 1 | 21 | 4 | 0.09 | 10 | MMA[a] | 4 | 1.05 | 90 | 60 | 80 | 90 | 36 | 0.6 |
| VII | 2/1 | 0.5 | 10 | 2 | 0.06 | 5 | MMA[a] | 2 | 0.11 | 120 | 60 | 174 | 71 | 62 | 3.9 |
| VIII | 2/2 | 1 | 20 | 4 | 0.07 | 10 | MMA[a] | 2.3 | 0.42 | 120 | 60 | 98 | 65 | 77 | 0.86 |
| IX | 1/2 | 1 | 20 | 4 | — | 10 | MA[b] | 4 | 0.02 | 90 | 80 | 282 | 79 | 89 | — |
| X | 1/1 | 1 | 21 | 4 | 0.09 | 10 | BA[c] | 3.6 | 0.21 | 90 | 23 | 265 | 86 | 85 | — |

[a] methyl methacrylate
[b] methyl acrylate
[c] butyl acrylate

What is claimed is:

1. A process for graft-polymerizing vinyl monomers onto cellulose fiber materials, which comprises the reaction of a fibrous carboxymethyl cellulose peroxide having a degree of substitution (DS) for the peroxide groups in the range of from 0.02 to 0.11, with a vinyl monomer in an aqueous medium in the presence of a ferrous iron compound at a temperature in the range of from 20° to 95° C.

2. The process as claimed in claim 1, wherein the DS for the peroxide groups is in the range of from 0.08 to 0.11.

3. The process as claimed in claim 1, wherein the carboxymethyl cellulose peroxide is derived from a fibrous carboxymethyl cellulose having a DS for the carboxyl groups in the range of from 0.1 to 0.7.

4. The process as claimed in claim 1, wherein the ferrous iron compound is employed in a ratio of $Fe^{2+}$ equivalents to peroxide equivalents in the range of from 0.01:1 to 5:1.

5. The process as claimed in claim 4, wherein the ratio of $Fe^{2+}$ equivalents to peroxide equivalents is in the range of from 0.15:1 to 0.5:1.

6. The process as claimed in claim 1, wherein the ferrous iron compound is ferrous ammonium sulphate.

7. The process as claimed in claim 1, wherein the vinyl monomer is a vinylcarbonyloxy group containing monomer.

8. The process as claimed in claim 1, wherein the temperature is in the range of from 50° to 85° C.

9. A polymer-grafted cellulose fiber material prepared by graft-polymerizing vinyl monomers onto cellulose fiber materials, which comprises the reaction of a fibrous carboxymethyl cellulose peroxide having a degree of substitution (DS) for the peroxide groups in the range of from 0.02 to 0.11, with a vinyl monomer in an aqueous medium in the presence of a ferrous iron compound at a temperature in the range of from 20° to 95° C.

10. An article containing a polymer-grafted cellulose fiber material prepared by the process for graft-polymerizing vinyl monomers onto cellulose fiber materials, which comprises the reaction of a fibrous carboxymethyl cellulose peroxide having a degree of substitution (DS) for the peroxide groups in the range of from 0.02 to 0.11, with a vinyl monomer in an aqueous medium in the presence of a ferrous iron compound at a temperature in the range of from 20° to 95° C.

* * * * *